US005183324A

United States Patent [19]

Thomas

[11] Patent Number: 5,183,324

[45] Date of Patent: Feb. 2, 1993

[54] LIGHTING ACCESSORY

[76] Inventor: Roy Thomas, 6808 S. May, Chicago, Ill. 60621

[21] Appl. No.: 755,548

[22] Filed: Sep. 5, 1991

[51] Int. Cl.[5] ..... F21L 15/08

[52] U.S. Cl. ..... 362/103; 362/105; 362/108; 362/155; 362/191; 362/200; 362/295

[58] Field of Search ..... 362/105, 103, 155, 186, 362/190, 191, 196, 200, 201, 203, 205, 295, 375, 806, 108; 200/60

[56] References Cited

U.S. PATENT DOCUMENTS

| | | | |
|---|---|---|---|
| 1,122,424 | 12/1914 | Sagebrecht | 200/60 |
| 1,267,436 | 5/1918 | Martin | 362/103 |
| 1,396,830 | 11/1921 | Gallagher | 362/205 |
| 2,480,800 | 8/1949 | Wickwire | 362/191 |
| 3,937,320 | 2/1976 | Chao et al. | 362/155 |

FOREIGN PATENT DOCUMENTS

| | | | |
|---|---|---|---|
| 705252 | 3/1965 | Canada | 362/103 |
| 1097976 | 7/1955 | France | 362/103 |
| 478892 | 3/1953 | Italy | 362/155 |

*Primary Examiner*—Ira S. Lazarus
*Assistant Examiner*—Y. Quach
*Attorney, Agent, or Firm*—Michael R. McKenna

[57] ABSTRACT

This invention relates to a lighting accessory which may be worn by an individual that allows the user to variably direct the light emissions along an arc of approximately 180 degrees in front of and above the user. Once the light is positioned, it can be operated hands-free. The apparatus is self-contained having a housing comprised of two members hingedly connected together. When the housing is opened by rotating one member about the common hinge axis relative to the other housing member, the internal light switch is triggered to activate the light source. The switch is operably responsive to the relative positions of the housing members, disengaging the light source from the power source when the members are closed and engaging the light source to the power source when the housing unit is open.

7 Claims, 1 Drawing Sheet 13
14
19
18
15
15
11
22
12

14
13
22
32
34
24
11
18
25
12

11
4
12
51
25
53
46
23
15
17
48
19
38
18
21
40
42
18
43
53
42
4

12
36
11
53
32a
23
46
32b
10
34b
29
17
50
38
20
53
21
40

20
43
44
12
10

36
32a
32b
34b
14a
34a
38
34c
38

34
14
32

LIGHTING ACCESSORY

BACKGROUND INVENTION

This invention relates to a lighting accessory which may be worn by an individual that allows the user to direct the position of the light beam in front of and above the user. Once the light is positioned, it can be operated hands-free.

U.S. Pat. No. 4,556,932, issued to Lehrer et al. in 1985, relates to a battery-powered lighting device with a removable face plate having a square, transparent area on the center of the face plate for transmitting light. The principal disadvantage of this device is that the light cannot be directed.

U.S. Pat. No. 4,423,473, issued to Kirkley in 1983, relates to a battery operated safety light which may be worn by athletes having a position sensitive switch which is sensitive to movement and provides intermittent bursts of light which are visible to oncoming vehicular traffic. The principal disadvantage is that while it provides a safety signal for oncoming traffic, it does not provide illumination of objects for the user.

U.S. Pat. No. 4,332,007, issued to Gibstein et al. in 1982, relates to a battery operated utility light which may be fastened to an article of clothing having a clear plastic cover through which light is disbursed. The Gibstein et al. device does not allow the light source to be directed and the device relies on an external switch which may be inadvertently left on to drain the battery.

ADVANTAGES OF THIS INVENTION

Unlike the foregoing devices which teach lighting devices with undirectable light sources, each teaches a self-contained casing having an externally disposed shut-off switches, the apparatus of the present invention is self-contained having a housing comprised of two members which when they are closed together automatically shut off the light source. Moreover, when the housing is opened by rotating one member about a common hinge axis relative to the other housing member the internal light switch is triggered to activate the light source. By positioning the housing members in any open configuration, the light emissions can be directed to illuminate an object for the user. Once a suitable direction for the light emission is obtained, the rotating member will frictionally maintain its rotated position and the user's hands are free for other needs. The device can variably direct the light emissions along an arc of approximately 180 degrees in front of and above the user. For example, one embodiment of the invention has the lighting accessory configured as a belt buckle where the user can partially open the housing to illuminate a path or unlit sidewalk area ahead of the user; further opening the rotating housing member to a horizontal position could serve to illuminate a door lock or the like; and opening the device more fully to position the rotating housing member in a vertical position could serve to illuminate the area above the user to replace a light bulb. Because the direction of the light emissions are frictionally maintained after manual positioning, the lighting accessory of the present invention can be used hands-free.

SUMMARY OF THE INVENTION

A self-contained lighting accessory, which may be worn by an individual, comprising a stationary housing member having a horizontal hinge at one end and a rotating housing member having a corresponding horizontal hinge at one end which are connected together at the hinge. The rotating housing member pivotally rotates about the axis of the hinge connection relative to the stationary housing member. The hinge connection has sufficient frictional resistance to support the weight of the rotating housing member in a various manually set rotational positions relative to the stationary housing member. It may also be positioned in front of and in alignment with the stationary housing member to form a closed housing unit.

Mounted on the rotating housing member at the end opposite its hinge is an electrically powered light source, such as a light bulb or light emitting diode, having it light emissions directed away from and perpendicular to the axis of the horizontal hinge.

The present invention further comprises an electrical power source, such as a battery, operably connected to an electrical switch to connect and disconnect the light source and the power source.

The closed housing unit is suitably sized to contain the power source, the light source, the electrical switch, and the associated electrical circuitry.

The switch may be operably responsive to the relative positions of the housing members, disengaging the light source from the power source when the rotating housing member is positioned in front of and in alignment with the stationary housing member forming a closed housing unit and engaging the light source to the power source when the housing unit is open.

BRIEF DESCRIPTION OF THE DRAWING

Preferred embodiments of the invention are described hereinafter with reference to the accompanying drawing wherein.

DETAILED DESCRIPTION OF THE INVENTION

Figure 4:
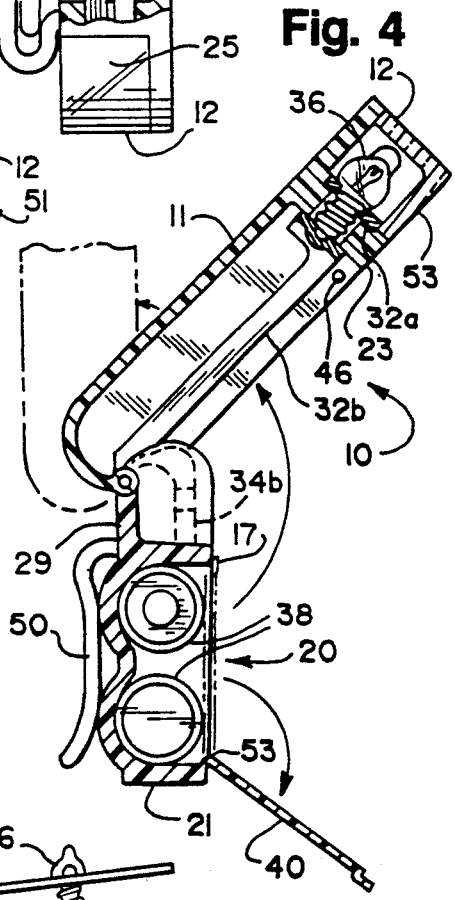
FIG. 4 is a side elevation sectional view of the lighting accessory of the present invention taken along the line 4—4 of FIG. 2 showing the location of the light source, light source retaining means and an associated corresponding contact arm which rotates in cooperation with the rotating housing member intersecting and coacting with the fixed contact arm of the stationary housing member, a clip for the attachment means, and, in phantom, the rotating housing member is shown rotated approximately 180 degrees from its closed position.

The preferred embodiments of the invention depicted in the drawing comprise a lighting accessory which can be adapted to be worn as a belt buckle, or clipped or pinned to a garment, and which is adapted to vary the direction of light above and in front of the user. The lighting accessory comprises a closeable housing having a stationary housing member 20 hingedly connected to a rotating housing member 10, an electrical power source 38, depicted in the drawing as two batteries connected in series, operably connected to an electrically powered light source 36 that is mounted on the rotating housing member 10 at the end opposite its horizontal hinge means 14 and having the light emissions of the light source 36 directed away from and perpendicular to the horizontal hinge means axis 14*a*, and a switch means 44 of FIG. 7 (or alternate switch means comprising contact arms (34*a* and 34*b*) with corresponding contact arms (32*a* and 32*b*, respectively) of FIG. 4) to engage and disengage the light source 36 and the power source 38. The housing further comprises a stationary housing member 20 having a belt loop 22 and belt hole nub 24 positioned on the rear of the stationary housing member 20. Alternatively, an attachment means comprising a clip 50 as shown in FIG. 4 may be provided on the rear surface of the rear wall 29.

Figure 1:
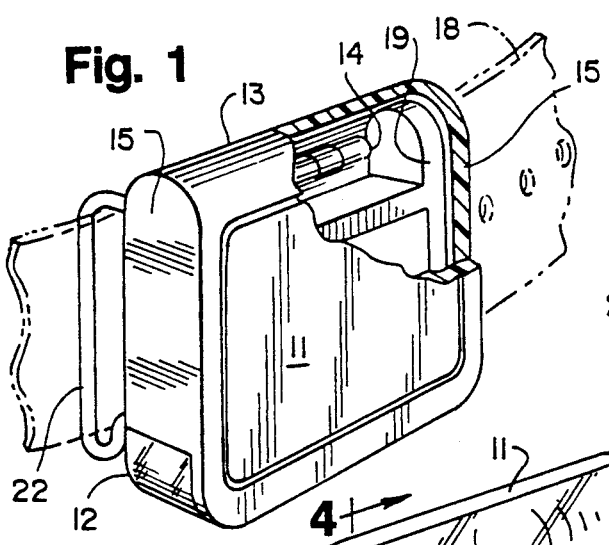
FIG. 1 is a perspective view of a first preferred embodiment of the lighting accessory of the present invention showing the attachment means being adapted for a belt, shown in phantom, and partially cut away to show the relationship of the stationary housing member and the rotating housing member when the latter is positioned in front of and in alignment with the former to form a closed housing unit.
Figure 3:
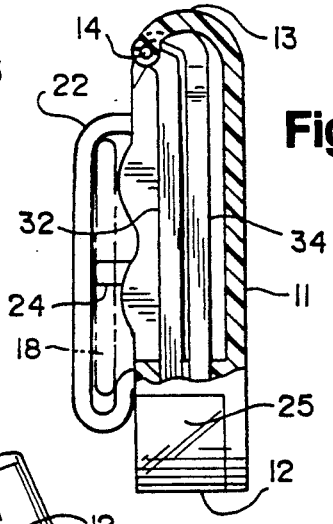
FIG. 3 is a side elevation view of the lighting accessory of FIG. 1 of the present invention taken along it right side and having said right side partially cut away to show the hinge means location and the alignment of a contact arm of the stationary housing member and a corresponding contact arm of the rotating housing member.

Referring to FIG. 1 of the drawing, a preferred embodiment of the lighting accessory shows the housing unit in a closed housing unit position. In the closed housing unit position, a cavity of the rotating housing member 10, as more clearly seen in FIG. 2, defined by the front wall 11 on the front and the top wall 13 on the top, the side walls 15 on the sides, and the reinforcing lower wall 23 on the bottom, envelops the stationary housing member 20. The rotating housing member 10 being positioned in front of and in alignment with the stationary housing member 20, to form the closed housing unit.

The various figures of the drawing show the cooperating hinge means 14 of the preferred embodiments of the lighting accessory located horizontally at the upper edge of the rear wall 29 of the stationary housing member 20 and at the rear edge of the top wall 13 of the rotating housing member 10.

It will become readily apparent to one skilled in the art that the cooperating hinge means could have as easily been located adjacent to the bottom of the device and the light source located at the opposite end, that is, adjacent to the top of the device. The drawing having depicted a preferred embodiments of the lighting accessory with the hinge means near the top and the light source near the bottom is not intended in any way to limit the scope of the invention.

Figure 2:
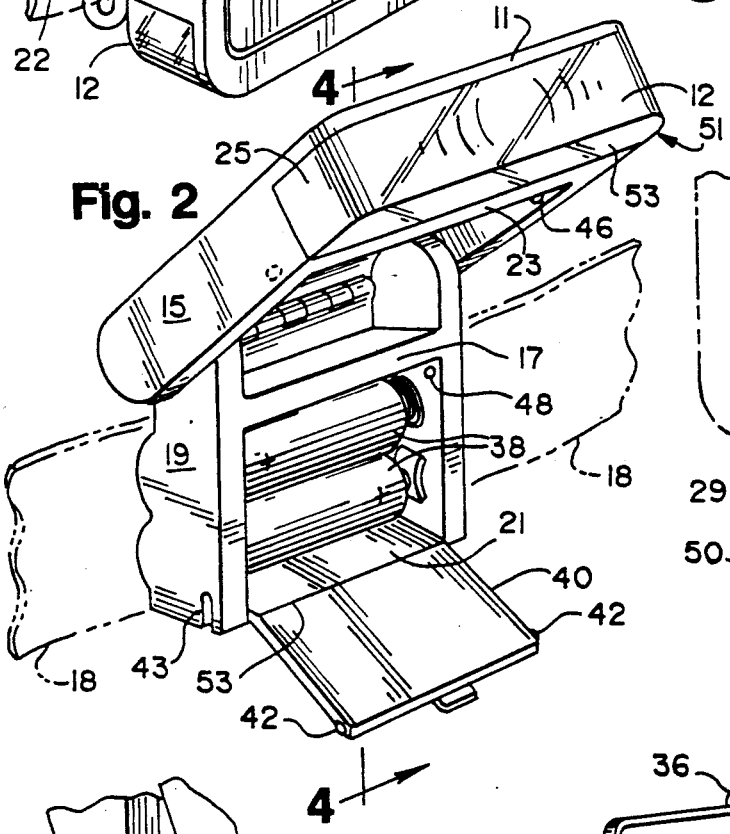
FIG. 2 is a perspective view of a preferred embodiment of the lighting accessory of the present invention taken when the housing unit is in an open position showing the rotating housing member positioned away from being in front of and in alignment with the stationary housing member, and further showing an open battery retaining door hingedly connected to the front edge of the base wall of the stationary housing member and the battery containing cavity.

Referring to FIG. 2, a preferred embodiment of the present invention is shown in an open position having the rotating housing member 10 pivotally rotated about the horizontal hinge means axis 14*a* relative to the stationary housing member 20 and positioned away from being in front of and in alignment with the stationary housing member 20.

The stationary housing member includes a base wall 21 a reinforcing upper wall 17, a rear wall 29 and two opposing side walls 19, the side and rear walls each generally lying in a vertical plane (spacial references throughout being made to the closed housing unit position), the base and reinforcing upper walls each generally lying in a horizontal plane, the rear and side walls each extending upward from and having their bottom edges connected to the rear and side edges, respectively, of the base wall 21, the rear wall 29 having its side edges connected to the rear side edges, respectively, of the side walls 19, the reinforcing upper wall 17 having its side edges connected to the side walls 19, respectively, and its rear edge to the rear wall 29.

A cavity of the stationary housing member 20 is defined by the base wall 21 on the bottom, the rear wall 29 on the rear, the side walls 19 on the sides, and a battery retaining door 40 hingedly connected to the front edge of the base wall 21 and arranged and adapted to be positioned in front of and in alignment with the front opening of the cavity, to close the cavity, and to move pivotally about the door hinge means 53, to allow access to the cavity. The door 40 having a latch means comprising detent recesses 48 positioned on the cavity defining surface of the side walls 19, respectively, and corresponding detent means 42 located on the side edges of the door 40 to coact with the detent recesses 48, to clasp the battery retaining door 40 in a closed position.

The side walls 19 have additional detent recesses 43 positioned on the bottom exterior surface thereof, to coact with detent means 46 of the rotating housing member, and have at least one penetration to accommodate the power source and associated retaining and contact means.

The rotating housing member 10 comprises a front wall 11, a top wall 13, a reinforcing lower wall 23 and two opposing side walls 15. The front wall 11 is generally lying in a vertical plane with a generally horizontal top edge and having a generally horizontal bottom edge that intersects with its generally vertical side edges, respectively, in a smoothly curving small radius of curvature manner.

The top wall 13 is an arcuate segment of approximately 180 degrees extending upward from the top edge of the front wall 11, having a radius of curvature of at least one half the width of the side walls measured to the inner surface of the segment, extending about a horizontal line located equidistant from the side edges of the side walls 15 and the top edge of the front wall 11, and having a horizontal rear edge.

The reinforcing lower wall 23 is generally lying in a horizontal plane and has at least one penetration to accommodate the light source and associated retaining and corresponding contact means, and the side walls 15 each extend downward from and have their side edges connected, respectively, to the side edges of the top wall 13 and the front wall 11, and the reinforcing wall 23 having its side edges connected to the bottom edge of the side walls 15, respectively, and its front edge connected to the front wall 11, the front wall 11 being of greater vertical extent than the side walls 15.

The corresponding horizontal hinge means 14 located at the rear edge of the top wall 13.

A cavity of the rotating housing member 10 is defined by the front wall 11 on the front and the top wall 13 on the top, the side walls 15 on the sides, and the reinforcing lower wall 23 on the bottom, and is suitably sized and adapted to envelop the stationary housing member 20 when the rotating housing member 10 is pivotally rotated about the horizontal hinge means axis 14*a* relative to the stationary housing member 20 and positioned in front of and in alignment with it, to form a closed housing unit.

The side walls 15 of the rotating housing member each having detent means 46 positioned on the bottom of the cavity defining surface thereof, to coact, respectively, with detent recesses 43 on the exterior side walls 19 of the stationary housing member 20.

The rotating housing member 10 may comprise a light cover 51 having a bottom wall 12 generally lying in a horizontal plane, a rear wall 53 and side walls 25, each generally lying in a vertical plane, with the rear and side walls extending upward from and having their bottom edges connected to the rear and side edges, respectively, the bottom wall 53 intersecting with each of the side walls 25 in a smoothly curving small radius of curvature manner and the light cover 51 being located at the end opposite the hinge means 14 and having the front edge of its bottom wall 12 and the front edge of each of its side walls 25 connected to the bottom edge and side edges, respectively, of the front wall 11 of the rotating housing member 10, and the top edges of each of its side walls 25 connected to the bottom edge of the side walls 15 and the side edges of the reinforcing wall 23, respectively, of the rotating housing member 10.

The bottom wall 12 of the light cover 51 having at least a translucent portion to allow light to be emitted. Alternatively, an apertured lens in the bottom wall 12 can be employed to focus the emitted light. An alternative embodiment may comprise a housing with a translucent portion or an apertured lens for the light emissions.

The closed housing unit, comprised of the stationary housing member 20 hingedly connected to the rotating housing member 10, and the rotating housing member 10 being positioned in front of and in alignment with the stationary housing member 20, is suitably sized and adapted to contain a power source 38 and power source retaining means comprising contact arms (34*a* and 34*b*) and power source connector 34*c*, the light source 36 and light source retaining means comprising corresponding contact arms (32*a* and 32*b*) and a switch means.

The switch means provided may be operably responsive to the rotational position of the rotating housing member 10 relative to the stationary housing member 20. The switch means disengages the light source 36 from the power source 38 when the rotating housing member 10 is positioned in front of and in alignment with the stationary housing member 20, that is, when the housing unit is closed. The switch means engages the light source to the power source when the housing unit is opened by rotating the rotating housing member about the horizontal hinge means axis away from being in front of and in alignment with the stationary housing member.

Figure 6:
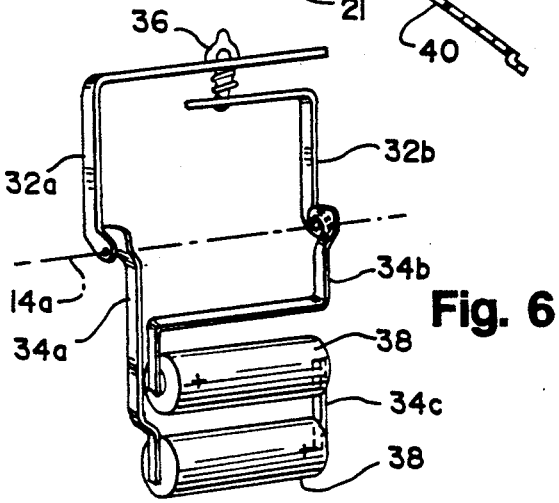
FIG. 6 is a detail perspective of the electrical elements of the preferred embodiment of FIG. 5 of the present invention comprising a battery source and associated contact arm, and a light bulb and associated corresponding contact arm, showing each arm extending toward and adjacent to the horizontal hinge means axis and said contact arms associated with the battery source having an offset at the end closest said hinge means, arranging and adapting same to intersect and coact when the rotating housing member is in an unclosed position.

In a preferred embodiment of the switch means, as shown in FIGS. 3, 4, 5 and 6, the switch means comprises contact arms 34*a* and 34*b* that are operably associated with the power source (38) and the corresponding contact arms (32*a* and 32*b*) that are operably associated with the light source (36). As shown in FIG. 6, the contact arms (34*a*, 34*b*) are mounted on the stationary housing member 20 and have at least one generally vertical contact arm (34*a* or 34*b*) extending toward and adjacent to the horizontal hinge means axis 14*a*, and the corresponding contact arms (32*a* and 32*b*) are mounted on the rotating housing member 10, move cooperatively with the rotating housing member and have at least one generally vertical corresponding contact arm (32*a* or 32*b*) extending toward and adjacent to the horizontal hinge means axis 14*a*. When only one contact and one corresponding contact arm are provided, a suitable grounding is provided to complete the circuit.

Figure 5:
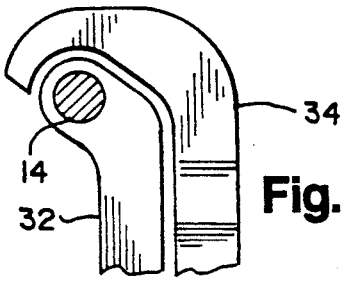
FIG. 5 is an partial side elevation detailed view of a contact arm of the stationary housing unit and a corresponding contact arm of the rotating housing unit of the lighting accessory of FIG. 3 of the present invention, showing each arm extending toward and adjacent to the horizontal hinge means axis and having a spaced position there between when the rotating housing member is in front of and in alignment with the stationary housing member.

Referring to FIG. 5, the corresponding contact arm (32*a* and 32*b*) each maintains a spaced position relative to the contact arms (34*a* and 34*b*, respectively), of the stationary housing member when the rotating housing member is in front of and in alignment with the stationary housing member, forming a closed housing unit. In FIG. 6 is shown the corresponding contact arms (32*a* and 32*b*), each having an offset at the end closest to the hinge means that is arranged and adapted to intersect and coact with the contact arms (34*a* and 34*b*), respectively, when the rotating housing member is in an unclosed position.

The corresponding contact arms (32*a* and 32*b*), moving cooperatively with the rotating housing member 10, are arranged to intersect and coact with the contact arms (34*a* and 34*b*) of the stationary housing member 20 when the rotating housing member is in an unclosed position, as shown in FIG. 4.

Figure 7:
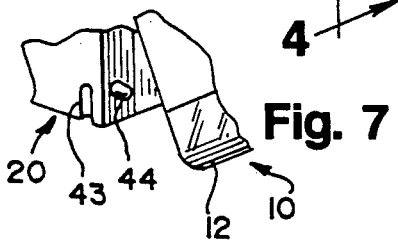
FIG. 7 is a detail perspective view of a preferred embodiment of the present invention showing a position of a spring-biased switch mounted on the stationary housing member.

Alternatively, with reference being made to FIG. 7, the switch means may comprises a spring-biased switch 44 normally in the circuit closed position, operably connected to the contact arms (34*a* and 34*b*) that are operably associated with the power source 38 and the corresponding contact arms (32*a* and 32*b*) that are operably associated with the light source 36, mounted on the stationary housing member 20 and arranged and adapted to coact with the rotating housing member 10 when it is positioned in front of and in alignment with the stationary housing member 20. The switch 44 is triggered to a circuit opened position when the housing unit is closed.

The lighting accessory further comprising a housing latch means arranged and adapted for engagedly clasping the stationary housing member 20 and the rotating housing member 10 together in a closed housing unit position.

The electrically powered light source may include a light bulb or light emitting diode; and the power source may comprise at least one replaceable battery centrally positioned in the cavity of the stationary housing member.

Depending on the choice of materials, certain rigidly flexible plastics, such as polypropylene or materials having like flexibility, could provide for an integral housing unit in which the lighting accessory of the present invention may be comprised of an integrally connected closable housing unit having a stationary housing section with a horizontal living hinge means at one end thereof hingedly connected to a rotating housing section that may be pivotally rotated about the horizontal living hinge means axis relative to the stationary housing section and positioned in front of and in alignment therewith, to form a closed housing unit.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

What is claimed is:

1. A lighting accessory, which may be worn by an individual, comprising:

a. a stationary housing member having a horizontal hinge means at one end thereof;

b. a rotating housing member having a corresponding horizontal hinge means at one end thereof, said stationary housing member and said rotating housing member, forming a housing unit, being arranged and adapted to being hingedly connected together and said hinge connection having a resistance means with sufficient frictional resistance to support the weight of the rotating housing member in a plurality of rotational positions relative to the stationary housing member, the rotating housing member may be positioned in front of and in alignment with said stationary housing member to form a closed housing unit, said closed housing unit being suitably sized and adapted to contain an electrical circuit comprising a power source and power source retaining means, a light source and light source retaining means, and a switch means;

c. an electrical power source operably connected to a power source retaining means;

d. an electrically power light source and light source retaining means mounted on the rotating housing member at the end opposite its hinge means and having the light emissions of said light source directed away from and perpendicular to a horizontal hinge means axis; and e. a switch means to engage and disengage the light source and the power source, whereby, the rotating housing member may be pivotally rotated about the horizontal hinge means axis relative to said stationary housing member to variably direct the light emissions along an arc of approximately 180 degrees.

2. The lighting accessory of claim 1 in which the switch means is operably responsive to the plurality of rotational positions of the rotating housing member relative to the stationary housing member, said switch means being arranged and adapted to disengage the light source from the power source when the rotating housing member is positioned in front of and in alignment with the stationary housing member, forming a closed housing unit, and said switch means being further arranged and adapted to engage the light source to the power source when the closed housing unit is opened by rotating the rotation housing member about the horizontal hinge means axis away from being in front of and in alignment with the stationary housing member, whereby the light source is activated when the housing unit is in a partially or fully open position.

3. The lighting accessory of claim 2 in which the switch means comprises a contact means operably associated with the power source and a corresponding contact means operably associated with the light source, said contact means being mounted on the stationary housing member and having contact arms extending toward and adjacent to the horizontal hinge means axis and having at least one offset at an end closest said horizontal hinge means, said corresponding contact means being mounted on the rotating housing member and moving cooperatively therewith and having corresponding contact arms extending toward and adjacent to the horizontal hinge means axis and having at least one spaced position relative to the contact arm of the stationary housing member when the rotating housing member is in front of and in alignment with the stationary housing member, forming a closed housing unit, and said corresponding contact arm, moving cooperatively the rotating housing member, is arranged to intersect and coact with the contact arm of the stationary housing member when said rotating housing member is in a partially or fully open position, whereby the intersection of the respective contact arms closes the electrical circuit and activates the light source as the housing unit is opened.

4. The lighting accessory of claim 2 in which the switch means comprises a spring-biased switch normally urged to a circuit closed position operably connected to a contact means operably associated with the power source and a corresponding contact means operably associated with the light source, said spring-biased switch being mounted on the stationary housing member and arranged and adapted to coact with the rotating housing member when it is positioned in front of and in alignment with the stationary housing member, whereby the spring-biased switch is triggered to a circuit opened position; and said lighting accessory further comprising a housing latch means arranged and adapted for engagedly clasping the stationary housing member and the rotating housing member together in a closed housing unit position.

5. The lighting accessory of claim 3 in which a. the stationary housing member includes:

(1) a base wall, a reinforcing upper wall, a rear wall and two opposing side walls, said side and rear walls each generally lying in a vertical plane, and at least one of said side walls has at least one penetration to accommodate the power source and associated retaining and contact means, said base and reinforcing upper walls each generally lying in a horizontal plane, said rear and side walls each extending upward from and having their bottom edges connected to the rear and side edges, respectively, of the base wall, said rear wall having its side edges connected to the rear side edges, respectively, of the side walls, said reinforcing upper wall having its side edges connected to the side walls, respectively, and its rear edge to the rear wall;

(2) the horizontal hinge means located at a upper edge of the rear wall;

(3) a cavity of the stationary housing member being defined by the base wall on the bottom, the rear wall of the rear, the side walls on the sides, and a battery retaining door hingedly connected to a front edge of the base wall and arranged and adapted to be positioned in front of and in alignment with a front opening of said cavity, to close said cavity, and to move pivotally about a door hinge means, to allow access to said cavity, said battery retaining door having a latch means comprising detent recesses positioned on the cavity defining surface of the side walls, respectively, and corresponding detent means located on the side edges of the battery retaining door to coact with the detent recesses, to clasp the battery retaining door in a closed position;

said side walls having additional detent recesses positioned on the bottom exterior surfaces thereof, to coact with detent means of the rotating housing member; and (4) an attachment means disposed on a rear surface of the rear wall;

b. the rotating housing member, as arranged in the closed housing unit position, includes:

(1) a front wall, a top wall, a reinforcing lower wall and two opposing side walls, said front wall generally lying in a vertical plane with a generally horizontal top edge and having a generally horizontal bottom edge that intersects with its generally vertical side edges, respectively, in a smoothly curving small radius of curvature manner, said top wall being an arcuate segment of approximately 180 degrees extending upward from the generally horizontal top edge of the front wall and having a radius of curvature of at least one half the width of the side walls measured to an inner surface of the segment, extending about a horizontal line located equidistant from the side edges of the side walls and the generally horizontally top edge of the front wall, and having a horizontal rear edge, said reinforcing lower wall generally lying in a horizontal plane and having at least one penetration to accommodate the light source and associated retaining and corresponding contact means, and said side walls each extending downward from and having their side edges connected, respectively, to the side edges of the top wall and the front wall, and the reinforcing lower wall having its side edges connected to the bottom edges of the side walls, respectively, and its front edge connected to the front wall, said front wall being of greater vertical extent than the side walls;

(2) the corresponding horizontal hinge means located at a rear edge of the top wall;

(3) a cavity defined by the front wall on the front and the top wall on the top, the side walls on the sides, and the reinforcing lower wall on the bottom, suitably sized and adapted to envelop the stationary housing member when the rotating housing member is pivotally rotated about the horizontal hinge means axis relative to said stationary housing member and positioned in front of and in alignment therewith, to form a closed housing unit;

(4) said side walls each having detent means positioned on the bottom of the cavity defining surfaces thereof, to coact, respectively, with detent recesses on the exterior side walls of the stationary housing member;

(5) a light cover having a bottom wall, a rear wall and side walls, said bottom wall generally lying in a horizontal plane, and said rear and side walls each generally lying in a vertical plane, said rear and side walls extending upward from and having their bottom edges connected to the rear and side edges, respectively, said bottom wall intersecting with each of the side walls in a smoothly curving small radius of curvature manner, and said light cover being located at the end opposite the horizontal hinge means and having a front edge of its bottom wall and the front edge of each of its side walls connected to the bottom edge and side edges, respectively, of the front wall of the rotating housing member;

said light cover having at least a translucent bottom wall, to allow light to be emitted therefrom;

c. the electrically powered light source includes a light bulb; and d. the power source comprises at least one replaceable battery centrally positioned in the cavity of the stationary housing member.

6. The lighting accessory of claim 4 in which a. the stationary housing member includes:

(1) a base wall, a reinforcing upper wall, a rear wall and two opposing side walls, said side and rear walls each generally lying in a vertical plane and at least one of said side walls has at least one penetration to accommodate the power source and associated retaining and contact means, said base and reinforcing upper walls each generally lying in a horizontal plane, said rear and side walls each extending upward from and having their bottom edges connected to the rear and side edges, respectively, of the base wall, said rear wall having its side edges connected to the rear side edges, respectively, of the side walls, said reinforcing upper wall having its side edges connected to the side walls, respectively, and its rear edge to the rear wall;

(2) the horizontal hinge means located at an upper edge of the rear wall;

(3) a cavity of the stationary housing member being defined by the base wall on the bottom, the rear wall of the rear, the side walls on the sides, and a battery retaining door hingedly connected to a front edge of the base wall and arranged and adapted to be positioned in front of and in alignment with a front opening of said cavity, to close said cavity, and to move pivotally about a door hinge means, to allow access to said cavity, said battery retaining door having a latch means comprising detent recesses positioned on the cavity defining surface of the side walls, respectively, and corresponding detent means located on the side edges of the battery retaining door to coact with the detent recesses, to clasp the battery retaining door in a closed position;

said side walls having additional detent recesses positioned on the bottom exterior surfaces thereof, to coact with detent means of the rotating housing member; and (4) an attachment means disposed on a rear surface of the rear wall;

b. the rotating housing member, as arranged in the closed housing unit position, includes:

(1) a front wall, a top wall, a reinforcing lower wall and two opposing side walls, said front wall generally lying in a vertical plane with a generally horizontal top edge and having a generally horizontal bottom edge that intersects with its generally vertical side edges, respectively, in a smoothly curving small radius of curvature manner, said top wall being an arcuate segment of approximately 180 degrees extending upward from the generally horizontal top edge of the front wall and having a radius of curvature of at least one half the width of the side walls measured to an inner surface of the segment, extending about a horizontal line located equidistant from the side edges of the side walls 15 and the generally horizontal top edge of the front wall 11, and having a horizontal rear edge, said reinforcing lower wall generally lying in a horizontal plane and having at least one penetration to accommodate the light source and associated retaining and corresponding contact means, and said side walls each extending downward from and having their side edges connected, respectively, to the side edges of the top wall and the front wall, and the reinforcing lower wall having its side edges connected to the bottom edges of the side walls, respectively, and its front edge connected to the front wall, said front wall being of greater vertical extent than the side walls;

(2) the corresponding horizontal hinge means located at a rear edge of the top wall;

(3) a cavity defined by the front wall on the front and the top wall on the top, the side walls on the sides, and the reinforcing lower wall on the bottom, suitably sized and adapted to envelop the stationary housing member when the rotating housing member is pivotally rotated about the horizontal hinge means axis relative to said stationary housing member and positioned in front of and in alignment therewith, to form a closed housing unit;

(4) said side walls each having detent means positioned on the bottom of the cavity defining surface thereof, to coact, respectively, with detent recesses on the exterior side walls of the stationary housing member;

(5) a light cover having a bottom wall, a rear wall and side walls, said bottom wall generally lying in a horizontal plane, and said rear and side walls each generally lying in a vertical plane, said rear and said walls extending upward from and having their bottom edges connected to the rear and side edges, respectively, said bottom wall intersecting with each of the side walls in a smoothly curving small radius of curvature manner, and said light cover being located at the end opposite the horizontal hinge means and having a front edge of its bottom wall and the front edge of each of its side walls connected to the bottom edge and side edges, respectively, of the front wall of the rotating housing member;

said light cover having at least a translucent bottom wall, to allow light to be emitted therefrom;

c. the electrically powered light source includes a light bulb; and d. the power source comprises at least one replaceable battery centrally positioned in the cavity of the stationary housing member.

7. A lighting accessory, which may be worn by an individual, comprising:

a. an integrally connected closable housing unit suitably sized and adapted to contain an electrical circuit comprising a power source and power source retaining means, a light source and light source retaining means, and a switch means, and having a stationary housing section with a horizontal living hinge means at one end thereof hingedly connected to a rotation housing section, and having a resistance means with sufficient frictional resistance to support the weight of the rotating housing section in a plurality of rotational positions relative to the stationary housing section;

b. an electrical power source operably connected to a power source retaining means;

c. an electrically powered light source and light source retaining means mounted on the rotating housing section at the end opposite its horizontal lining hinge means and having the light emissions of said light source directed away from and perpendicular to a horizontal hinge means axis; and d. a switch means to engage and disengage the light source and the power source, whereby, the rotating housing section may be pivotally rotated about a horizontal living hinge means axis relative to said stationary housing section to variably direct the light emissions along an arc of approximately 180 degrees, and the rotation housing section may be positioned in front of and in alignment with said stationary housing section to form a closed housing unit.

* * * * *